US008839881B1

(12) United States Patent
Baumler

(10) Patent No.: US 8,839,881 B1
(45) Date of Patent: Sep. 23, 2014

(54) TUBULAR HANDLING DEVICE

(76) Inventor: Richard Baumler, Heath, TX (US)

( * ) Notice: Subject to any disclaimer, the term of this patent is extended or adjusted under 35 U.S.C. 154(b) by 86 days.

(21) Appl. No.: 13/306,049

(22) Filed: Nov. 29, 2011

Related U.S. Application Data

(60) Provisional application No. 61/418,109, filed on Nov. 30, 2010.

(51) Int. Cl.
*E21B 19/00* (2006.01)

(52) U.S. Cl.
USPC ..... 175/85; 414/22.63; 414/22.68

(58) Field of Classification Search
CPC ..... E21B 19/20; E21B 19/15; E21B 19/155; E21B 19/14; B21C 47/24; B65H 2405/422; A01D 87/127
USPC ..... 414/22.51–22.71, 910, 911; 175/85
See application file for complete search history.

(56) References Cited

U.S. PATENT DOCUMENTS

| | | | | | |
|---|---|---|---|---|---|
| 3,533,516 | A * | 10/1970 | Guier | 414/22.51 |
| 3,771,389 | A * | 11/1973 | Coyne | 81/54 |
| 4,077,525 | A * | 3/1978 | Callegari et al. | 414/22.63 |
| 4,172,684 | A * | 10/1979 | Jenkins | 414/22.68 |
| 4,274,778 | A * | 6/1981 | Putnam et al. | 414/22.71 |
| 4,397,605 | A * | 8/1983 | Cowgill et al. | 414/22.71 |
| 4,441,839 | A * | 4/1984 | Baduel et al. | 405/202 |
| 4,444,275 | A * | 4/1984 | Beynet et al. | 175/7 |
| 4,643,624 | A * | 2/1987 | Murphree | 414/22.61 |
| 7,117,938 | B2 * | 10/2006 | Hamilton et al. | 166/77.53 |
| 7,350,587 | B2 * | 4/2008 | Springett et al. | 166/380 |
| 7,431,550 | B2 * | 10/2008 | Thompson | 414/22.54 |
| 7,552,775 | B2 * | 6/2009 | Pietras | 166/380 |
| 2005/0135902 | A1 * | 6/2005 | Spisak | 414/22.51 |
| 2007/0017703 | A1 * | 1/2007 | Belik | 175/52 |
| 2009/0126941 | A1 * | 5/2009 | Laitolais et al. | 166/377 |

* cited by examiner

*Primary Examiner* — Gregory Adams
*Assistant Examiner* — Lynn Schwenning
(74) *Attorney, Agent, or Firm* — Stein IP, LLC

(57) ABSTRACT

A device and method for handling a tubular on a drilling rig. The device includes a base, an arm mount coupled to the base, a support arm rotatably connected to the arm mount, and a tubular guide coupled to support arm. The base may include a guide disposed into the base, where the guide contains a circular portion which is concentric to a well center, and the arm mount slidably disposed in the guide.

28 Claims, 17 Drawing Sheets

TUBULAR HANDLING DEVICE

CROSS-REFERENCE TO RELATED APPLICATION

This application claims the benefit of U.S. Provisional Application No. 61/418,109 filed Nov. 30, 2010, the disclosure of which is incorporated herein by reference.

BACKGROUND

1. Field of the Invention

The present disclosure relates to a method and apparatus for tubular handling for well drilling operations.

2. Description of the Related Art

The drilling and production operation involves various tubular elements including drill pipe, drill collars, production tubing, well casing, bottom hole assembly, and riser pipe. These tubulars are moved to/from storage location to well center and/or the mousehole. The tubulars could be stored horizontally alongside the drilling rig and/or the tubulars could rest vertical on the drill floor. During operations tubulars stored horizontally alongside the drilling rig are transported, up to the rig floor, and rotated vertical, where they are added to the drill string or mousehole. This process is reversed to return the tubular to the horizontal storage location. The tubulars that are stored vertical are picked up off the drill floor and the lower end of the tubular is swung to/from the well center or mousehole.

During handling tubulars from the storage locations to/from the well center and/or mousehole, an elevator is attached to the top portion of the tubular to lift the tubular above the drill floor. While the top portion of the tubular is lifted above the drill floor the lower portion of the pipe is manually positioned to the desired location being well center, mousehole, or storage location. Because the lower end of the tubular is hanging freely and unsupported, this task often presents a hazard to the personnel on the drill floor as they try to maneuver the tubular to the desired location. A rope is often used to manually guide the lower portion of the tubular to the desired location.

There are devices for positioning the lower end of the tubular to well center. These devices have limited capability due to limited reach or movement. Some can only position tubulars from the edge of the drill floor to well center while others can only position the tubular once it is located very close to well center. These devices have not seen successful utilization to any extent in the drilling operations. These devices have disadvantages: limited capability; they are complex in nature, thus expensive; difficult to install and operate; hard to transport; and provide unsatisfactory results.

Therefore, an improved method and apparatus for handling tubulars to/from storage locations to well center and/or the mousehole is needed.

SUMMARY OF THE INVENTION

Aspects of the invention relate to a method and apparatus for handling a tubular above the drill floor comprising: a base, a guide located in the base, an arm mount slidably disposed along the guide, a support arm pivotably disposed on the arm mount, and a tubular guide pivotably attached to the support arm.

According to various embodiments, the apparatus includes the base anchorable to the drill floor and disposed in a manner such that the guide extends concentric with well center and the support arm having a first end slidably and pivotably disposable on the guide and a second end constructed and arranged with a tubular guide to contact and urge and end of the tubular suspended from above in the direction towards/away from well center.

According to various embodiments, the arm may include a telescopic section which can be extended and retracted by an actuator.

Various embodiments of the invention are also directed to a method of positioning a tubular from the edge of the drill floor to well center. In one embodiment, the method includes removably attaching a tubular handling device to the drill floor around well center. The tubular handling device is comprised of and arm slidably and pivotably disposed along the guide. The method further includes lifting an upper portion of the tubular pipe using an elevator and moving the upper portion of the tubular towards well center using the elevator while supporting the lower portion of the tubular with the tubular handling device.

In one embodiment, the method includes lifting the upper end of the tubular above the drill floor and urging the lower end of the tubular pipe towards well center with the first end of the arm pivoting, while the second end of the arm moves along the pivot point and rotates to well center. The tubular handling device may be actuated to limit movement of the tubular as it is moved towards the well center. With the lower end of the tubular limited by the tubular handling device the tubular is positioned above well center. Note the same process could align the lower portion of the tubular to the mousehole.

Another aspect of the invention provides a method for transferring the lower portion of a tubular along the drill floor from vertical storage locations to well center or mousehole location. The arm is slidably rotated along the guide until the arm, aligns with a tubular located in the vertical storage area. The upper end of the tubular is moved to a position generally at well center. The arm is rotated until it makes contact with the tubular and is guided to well center as described above.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE DRAWINGS

Reference will now be made in detail to the exemplary embodiments of the present disclosure, examples of which are illustrated in the accompanying drawings, wherein like reference refer to like elements throughout. The exemplary embodiments are described below, in order to explain the present disclosure, by referring to the figures.

Figure 1:
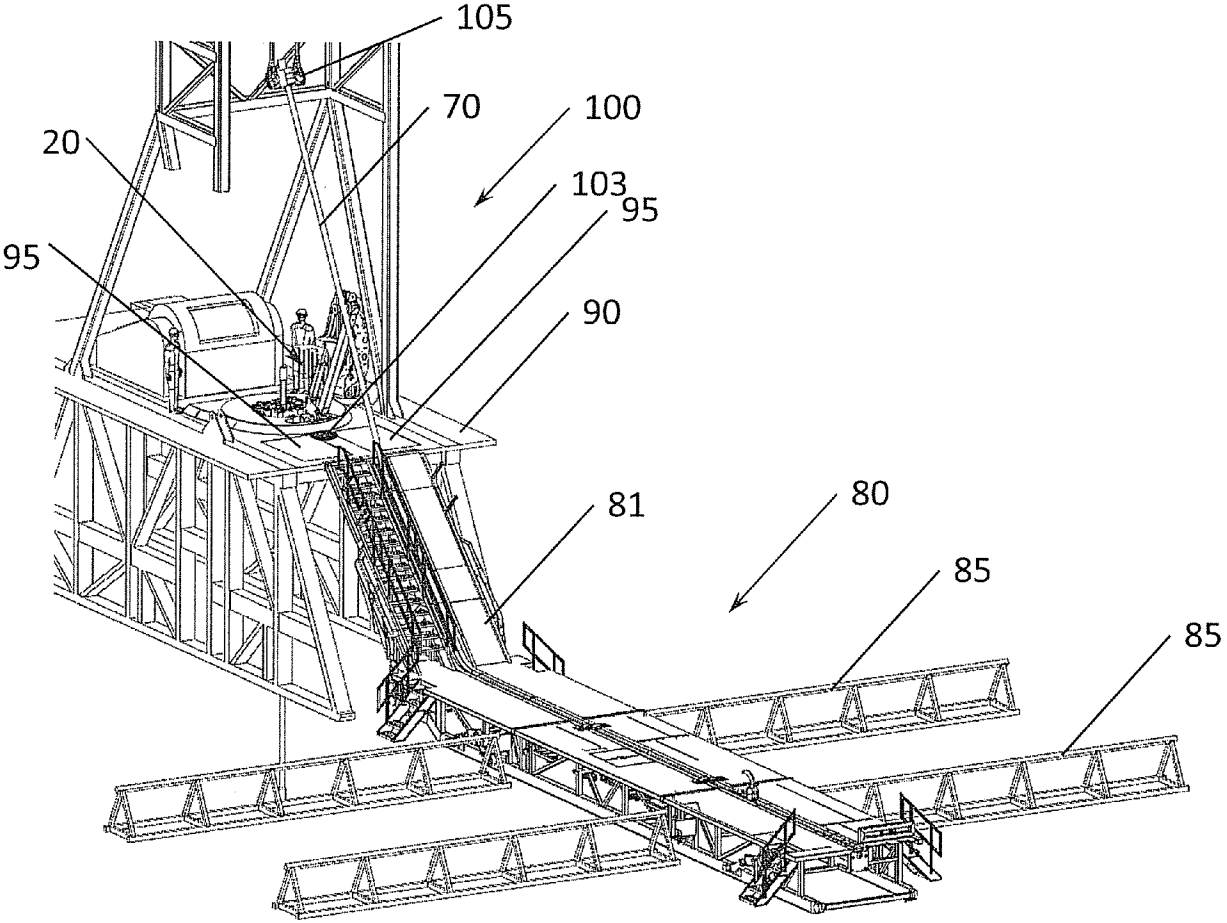
FIG. 1 illustrates a perspective view of a tubular handling device, a pick-up and lay-down system and a drilling rig, according to various embodiments of the present invention.

FIG. 1 illustrates a tubular handling device 20 located on a drill floor 90 of a drilling rig 100, and a tubular 70 is attached to an elevator 105. Adjacent is located a pick-up and lay down system 80, with a v-door ramp 81. Also illustrated are a horizontal tubular storage area 85 and a vertical tubular storage area 95.

Figure 2A:
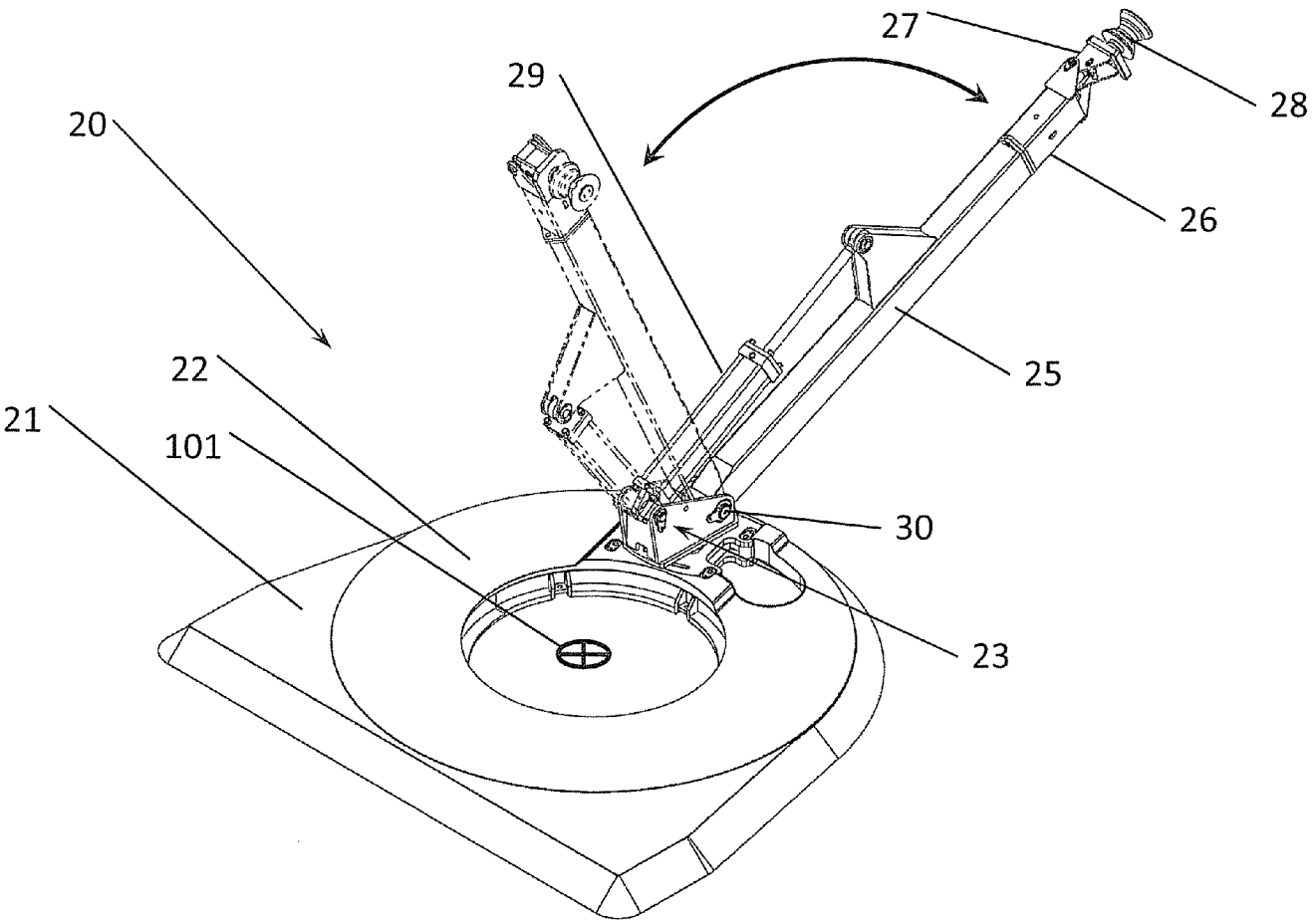
FIGS. 2A and 2B illustrate perspective views of the tubular handling device, according to various embodiments of the present invention.
Figure 2B:
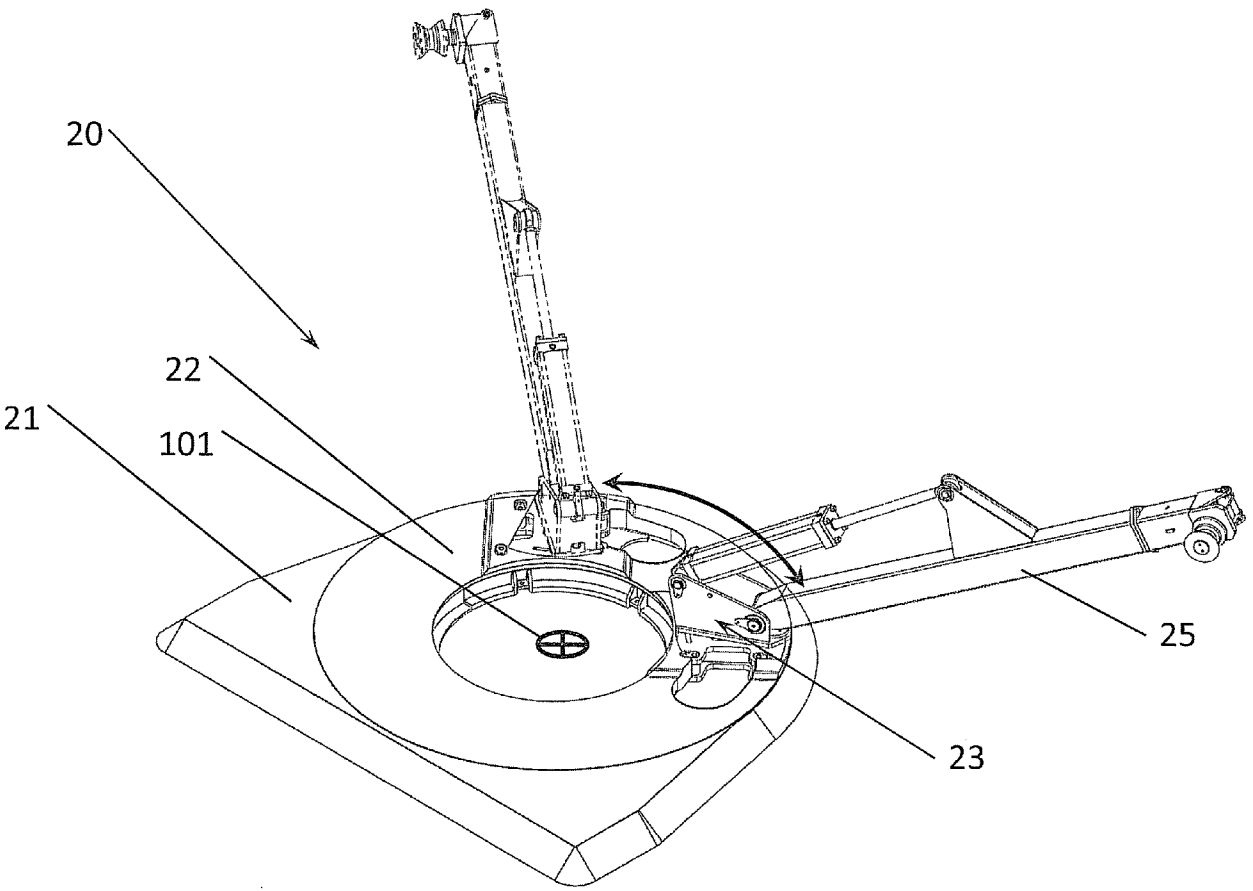

FIGS. 2A and 2B illustrate the tubular handling device 20 according to an aspect of the invention. The tubular handling device 20 includes a base 21 which is configured to be removably attached to the drill floor 90 (see FIG. 1). Located in the base is a guide 22, with circular portions of the guide 22 sharing the same axis as a well center 101. The tubular handling device 20 further includes an arm mount 23 slidably disposed on the guide 22. The arm mount 23 is coupled to a drive system 24 (see FIG. 8A) which provides a mechanism to move the arm mount 23 along the guide 22 and thereby rotating the arm mount 23 such that it is concentric with the well center 101.

Rotatably connected to the arm mount 23 is a support arm 25. The support arm 25 pivots about an axis 30, between a generally horizontal position (lowered position), and a generally past vertical position as to rotate portions of the support arm 25 past the well center 101 axis (upper position). However, aspects of the invention are not limited thereto such that the support arm 25 may be rotated about the axis 30 to an inclined position (i.e., a position between the lowered position and the upper position). Alternately, two support arms 25 could be incorporated to perform this task. The support arm 25 is rotated about the pivotable connection by an actuator 29, but the present invention is not limited thereto.

FIG. 2B illustrates the arm mount 23 and the support arm 25 in various positions as it rotates concentrically about the well center 101. However, aspects of the invention are not limited thereto such that the arm mount 23 and the support arm 25 may be rotated to an intermediate position along this rotation. Also aspects of the invention are not limited thereto such that the arm mount 23 and the support arm 25 could be slid to a position way from the well center 101 and not concentric to the well center 101 as to provide clearance around the well center 101.

FIG. 2A illustrates the support arm 25 as it rotates towards and away from the well center 101. However, aspects of the invention are not limited thereto such that the support arm 25 may be rotated to an intermediate position along this rotation.

Figure 3:
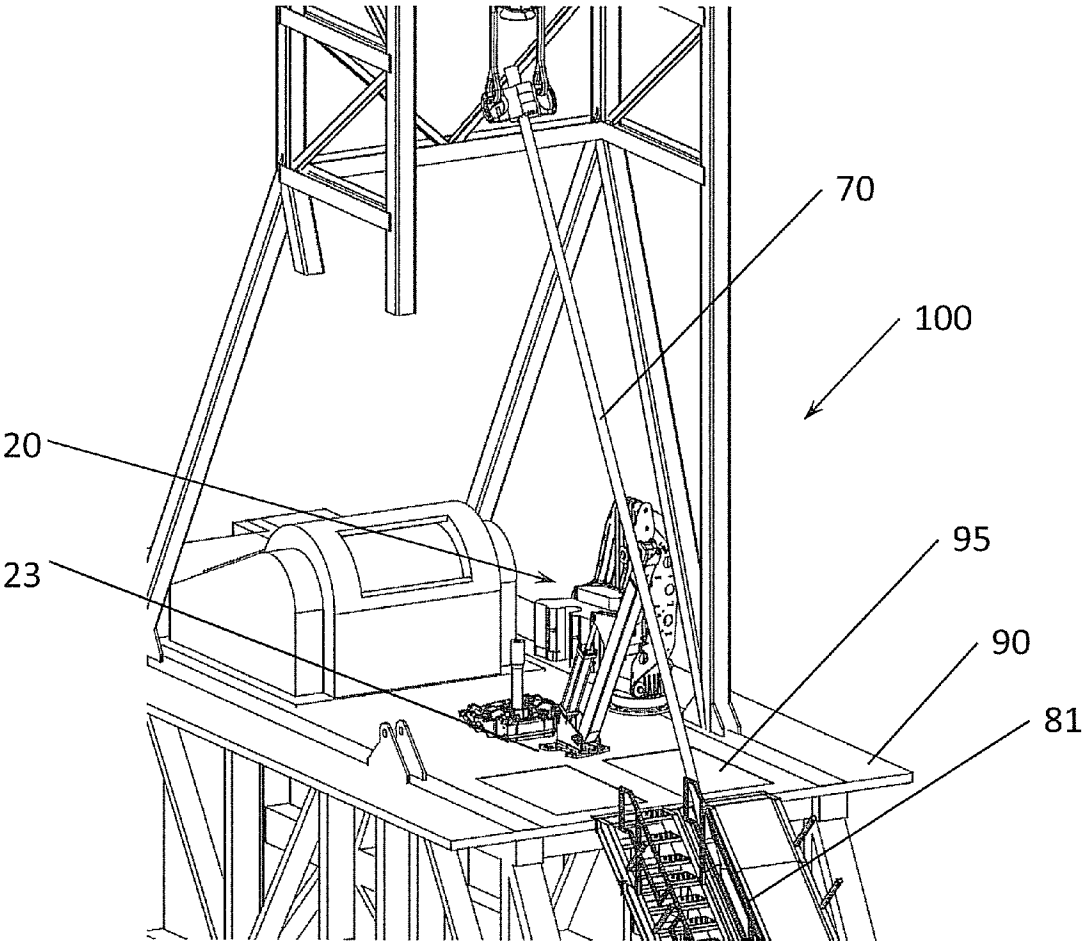
FIG. 3 illustrates a perspective view of the tubular handling device, and a drilling rig, according to various embodiments of the present invention.

An alternative configuration for the tubular handling device 20 as FIG. 3 illustrates is directly connecting the arm mount 23 to the drill floor 90. As such, the base 21 need not be used in all aspects and/or need not be disconnectable from the floor 90.

Figure 4:
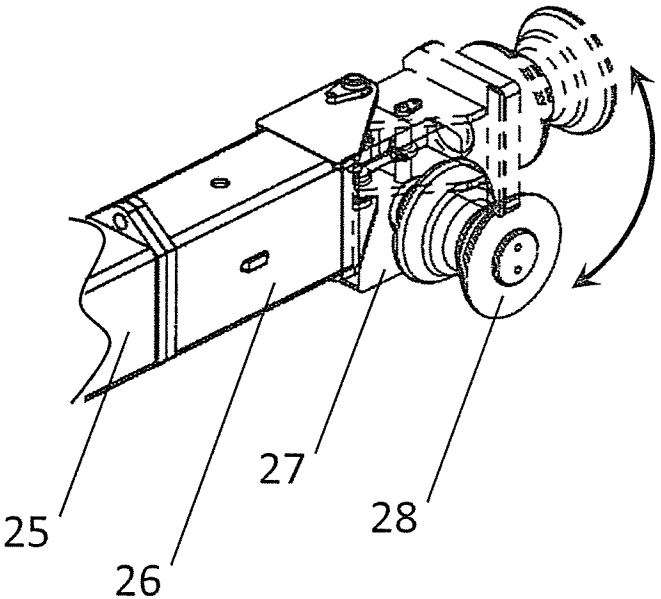

FIG. 4 illustrates a guide support 27 pivotally connected at one end of an arm guide section 26, the guide support 27 rotates about this pivot between generally perpendicular with respect to the support arm 25 position (extended position) and a generally parallel with respect to the support arm 25 position (retracted position). The guide support 27 may be rotated about the pivotable connection by an actuator 26A (see FIG. 5B), but the present invention is not limited thereto.

A tubular guide 28 is located on the guide support 27. The tubular guide 28 is allowed to rotate about its central axes. Aspects are not limited thereto, as the tubular guide 28 need not rotate, such as where the tubular 70 slides. The tubular guide 28 having an hourglass shape (i.e., decreasing diameter and a minimum diameter at a central axis corresponding with a vertical plane going through the well center 101 axis when the guide support 27 is in the extended position) so as to help maintain the tubular 70 along the central axis. However, aspects are not limited thereto, as the tubular guide 28 is not limited to a specific cross section shape.

Figure 5A:
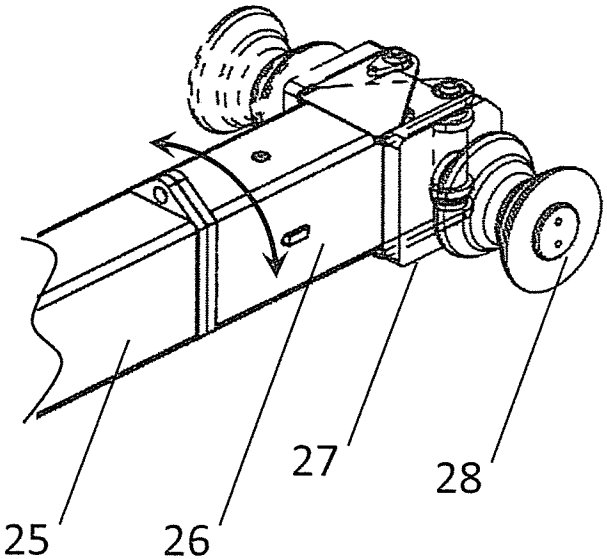
FIGS. 4-5B illustrate perspective views of a tubular guide, according to various embodiments of the present invention.
Figure 5B:
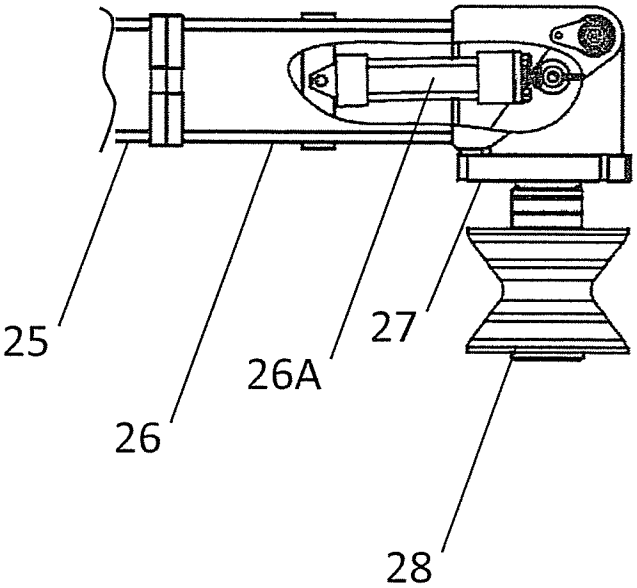

FIG. 5A illustrates the arm guide section 26 which can pivot about the longitudinal axis of the support arm 25 to reposition the tubular guide 28 with respect to the support arm 25. Repositioning the tubular guide 28 increases access to the tubular 70 during the handling process.

Figure 6:
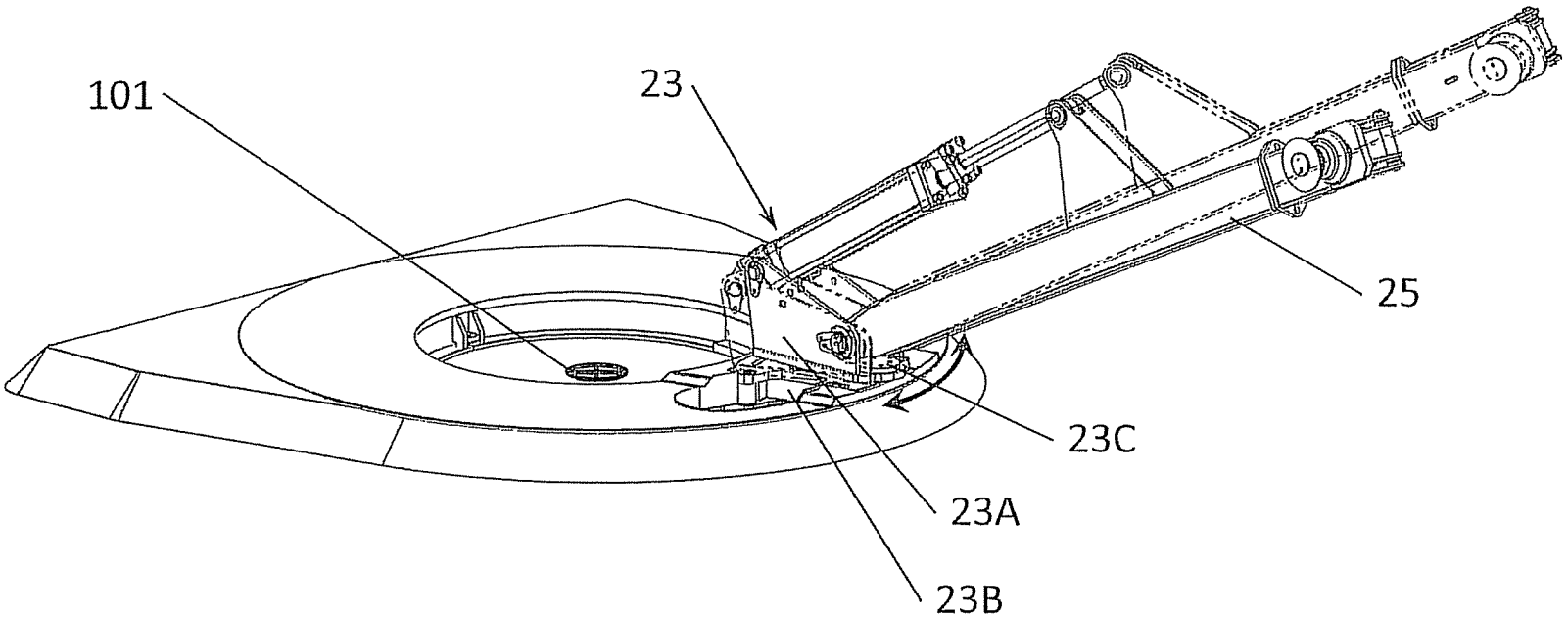
FIG. 6 illustrates a perspective view of the tubular handling device, and arm mount, according to various embodiments of the present invention.

FIG. 6 illustrates the arm mount 23 comprising an arm attachment 23A which is attached to an arm mount base 23. The arm attachment 23A can pivot about an axis 23C generally parallel with the well center 101 axis. Rotating the arm attachment 23A about the pivot axis 23C increases the access to the tubular 70 during the handling process and fine tunes the alignment to the well center 101

Figure 7:
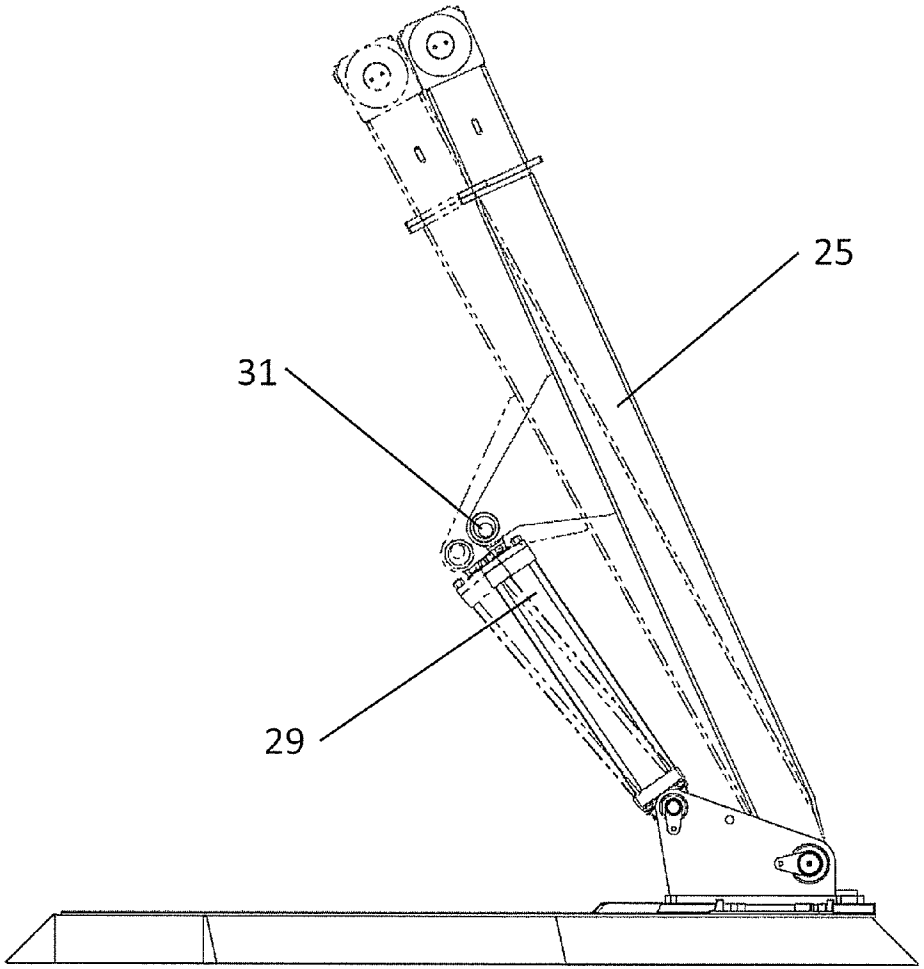
FIG. 7 illustrates a side perspective view of the tubular handling device, and actuator, according to various embodiments of the present invention.

FIG. 7 illustrates an axis 31 in an alternate configuration according to an aspect of the invention. The axis 31 can be reconfigured to increase the travel of support arm 25 without changing the length of travel for actuator 29.

Figure 8A:
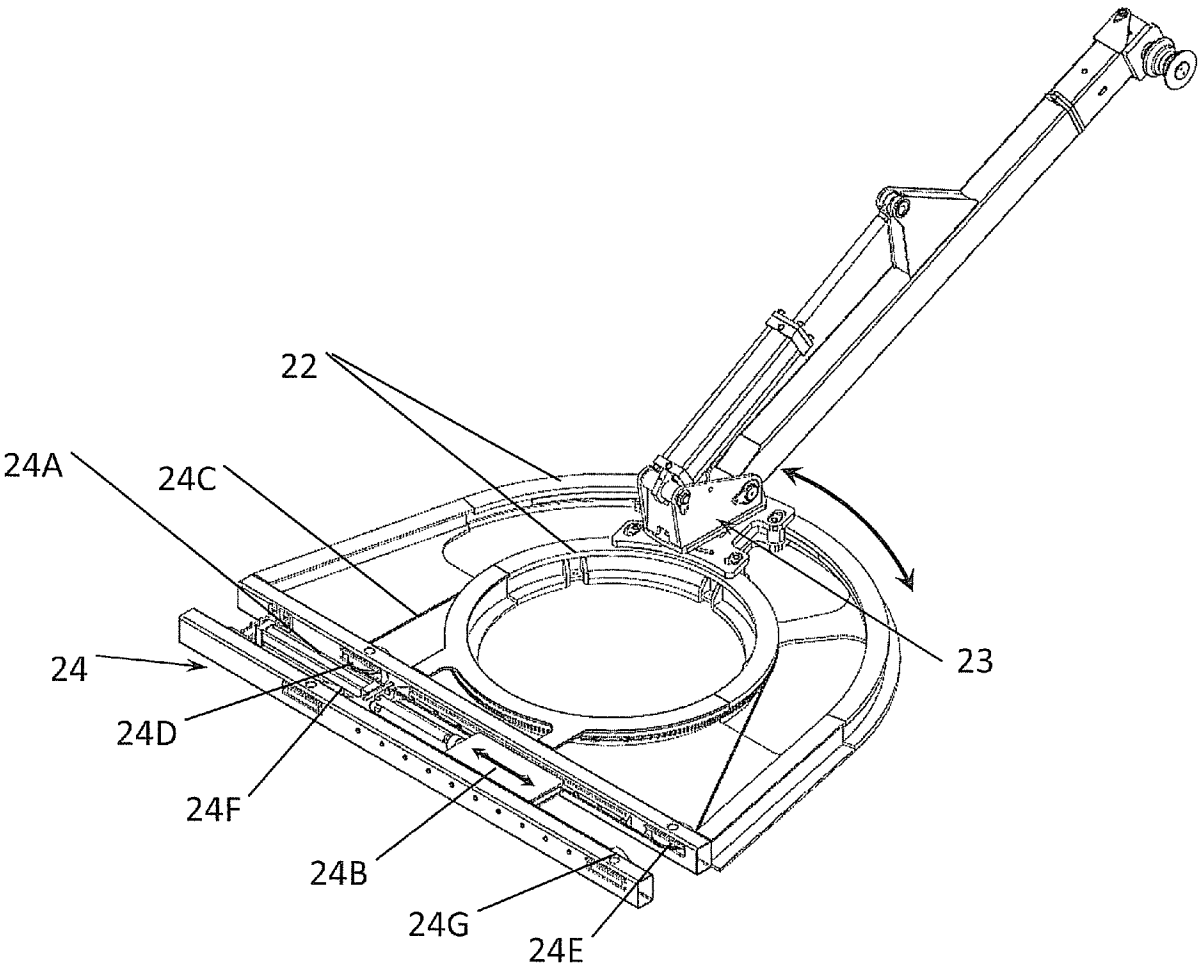
FIGS. 8A and 8B illustrate perspective views of the tubular handling device, and drive system, according to various embodiments of the present invention.

FIG. 8A illustrates the drive system 24 used as a mechanism to move the arm mount 23 along the guide 22 according to an aspect of the invention. A drive actuator 24A moves a pulley block 24B. Passing over the pulleys located in the pulley block 24B is a wire 24C. The wire 24C is connected to the arm mount 23, passes over pulleys 24D and 24E and terminated in connectors 24F and 24G. The wire 24C could be replaced with or supplemented by a belt or chain according to aspects of the invention.

Figure 8B:
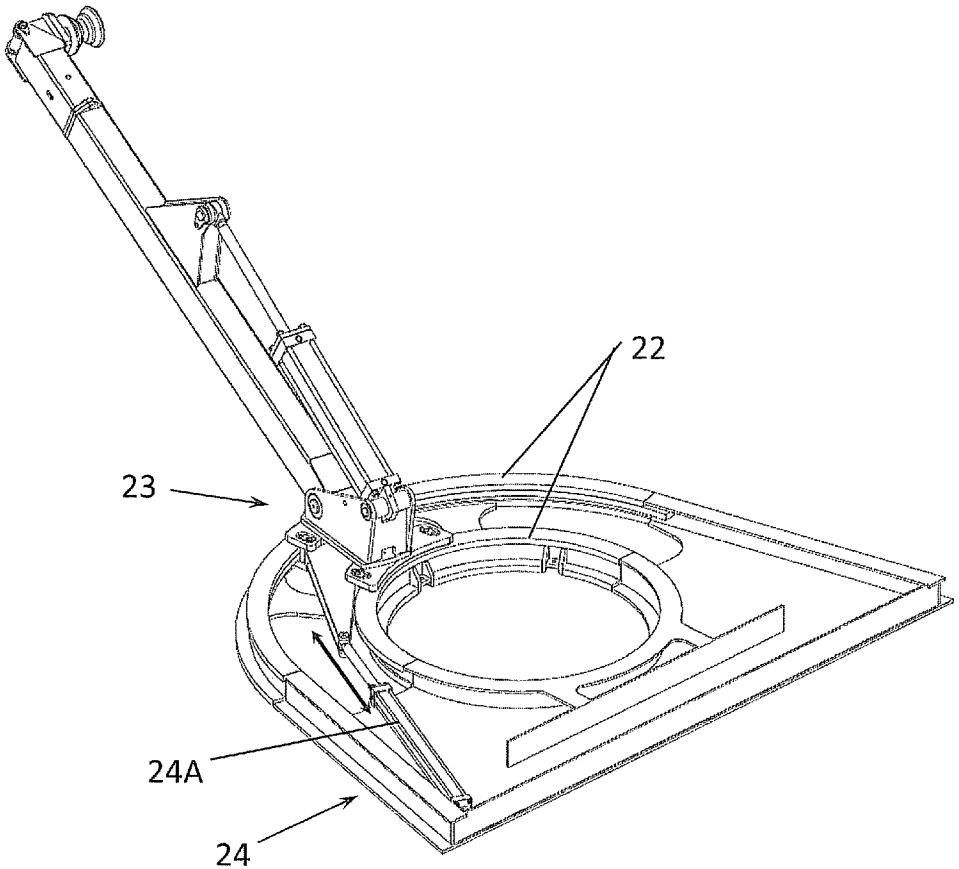

There are various possibilities with regard to the drive system 24 as illustrated in FIG. 8B. In this embodiment, the drive actuator 24A is directly coupled to the mount 23 to provide a mechanism to move the arm mount 23 along the guide 22. The drive system could also consist of a drive motor that that is coupled to belts or chains to slide the arm mount 23 or a gear system to drive the arm mount 23.

Figure 9:
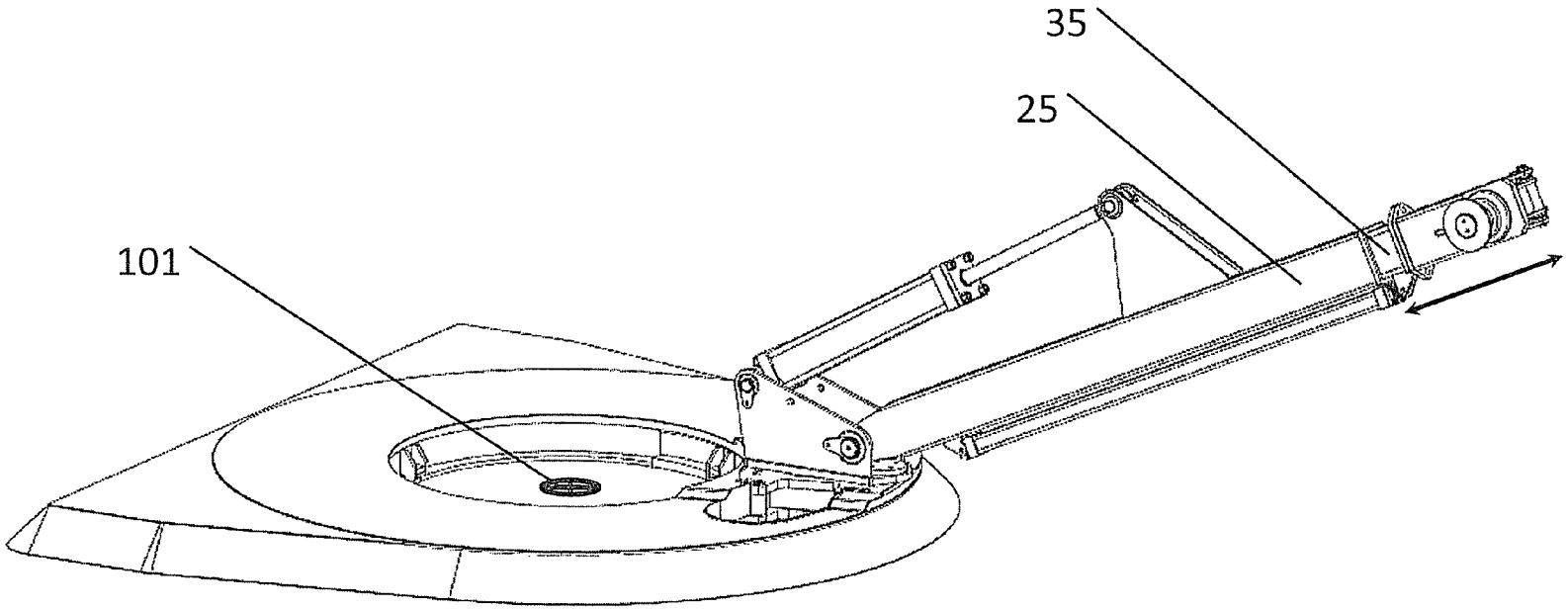
FIG. 9 illustrates a perspective view of the tubular handling device, and telescoping member according to various embodiments of the present invention.

FIG. 9 illustrates another configuration of the tubular handling device with a telescoping member 35 according to an aspect of the invention. The telescoping member 35 extends out of the support arm 25 to give the tubular handling device extra reach capability.

Figure 11:
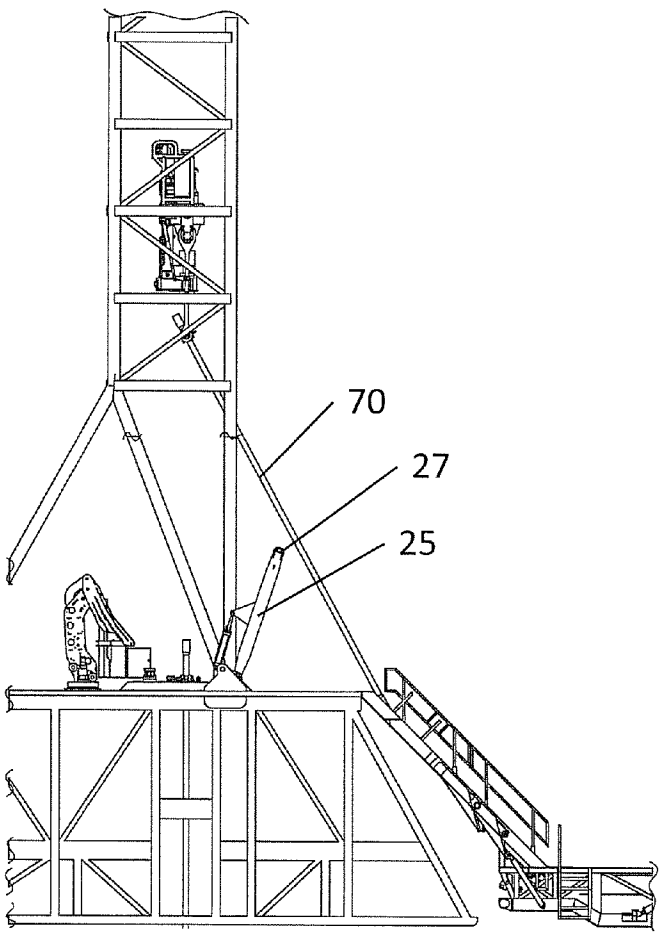
FIGS. 10-17 illustrate side perspective views of a method for positioning a tubular from the edge of a drill floor to well center, according to various embodiments of the present invention.
Figure 10:
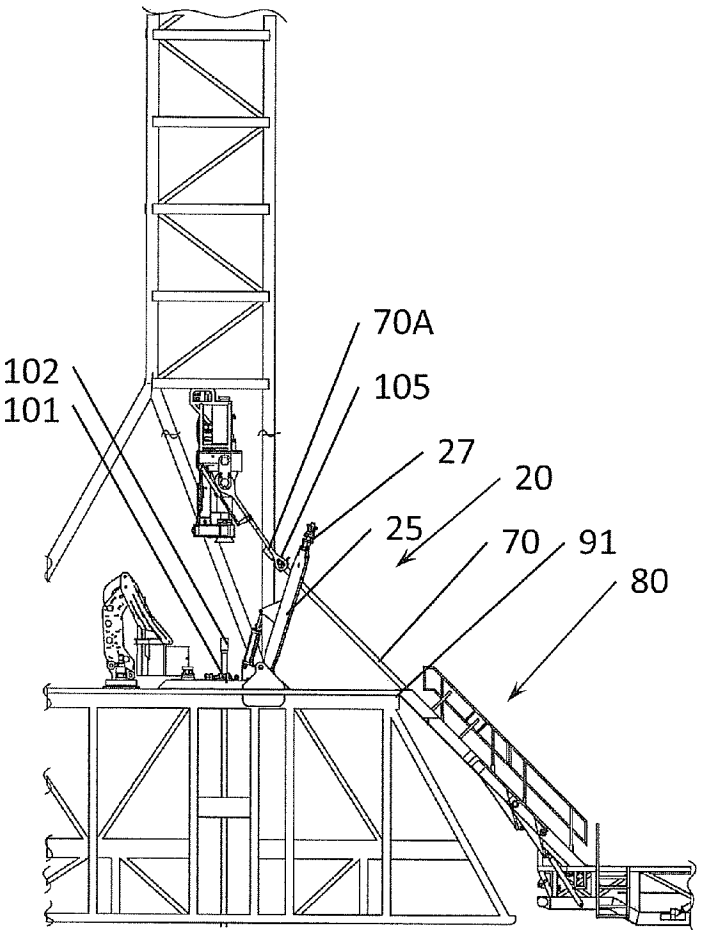
Figure 13:
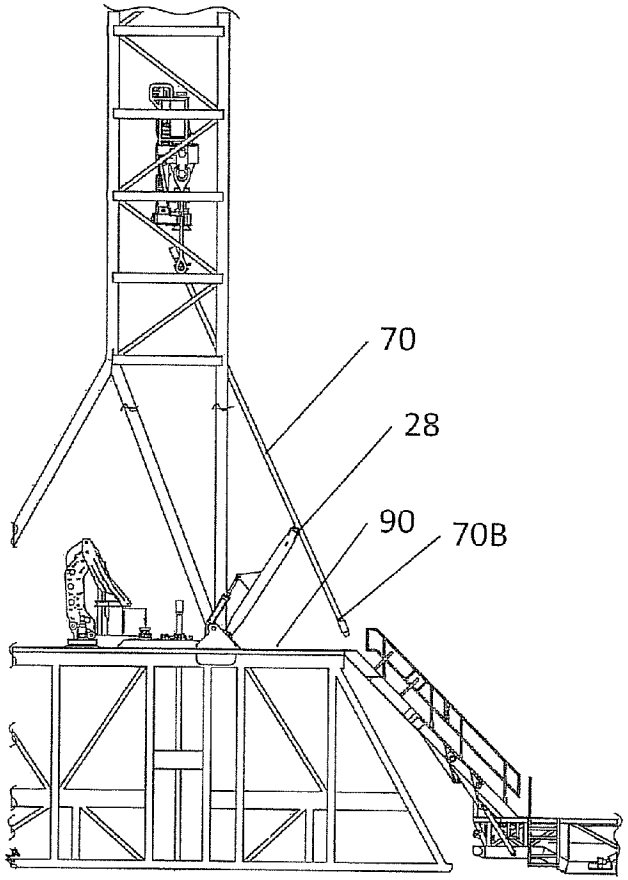
Figure 12:
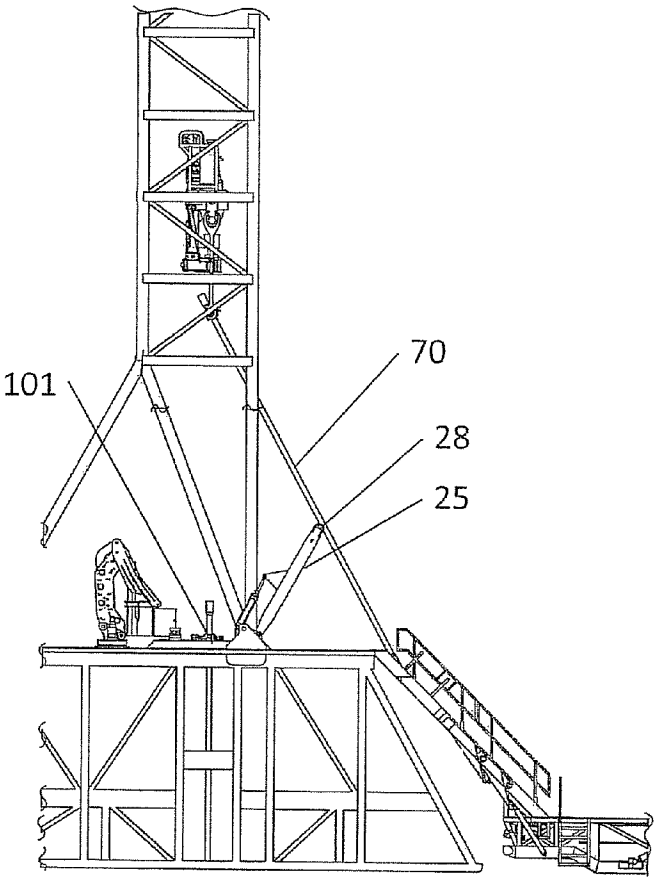
Figure 14:
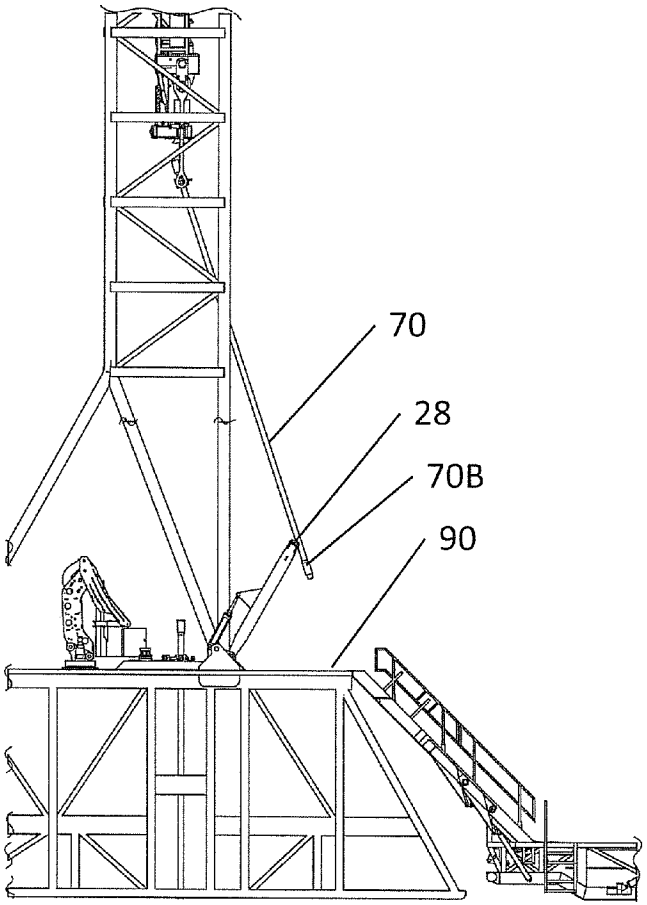

FIGS. 10-17 illustrate a method of using the tubular handling device 20 to transfer the tubular 70 from the pick-up and lay down system 80 or a drill floor edge 91 to a drill string 102 located at the well center 101 according to an aspect of the present invention. As shown in FIG. 10, the elevator 105 or lifting line not shown is attached to the top portion 70A of the tubular 70. The guide support 27 is in its retracted position, with the support arm 25 in an intermediate position. Then, as shown in FIG. 11, the tubular 70 is raised. After the mid section of the tubular 70 passes the guide support 27 the guide support 27, is actuated to its extended position. FIG. 12 shows the support arm 25 rotated way from well center 101 such that the tubular guide 28 makes contact with tubular 70. FIGS. 13-14 shows the tubular 70 is raised higher and the lower end 70B of the tubular 70 is supported off of the drill floor 90 by the tubular guide 28.

Figure 15:
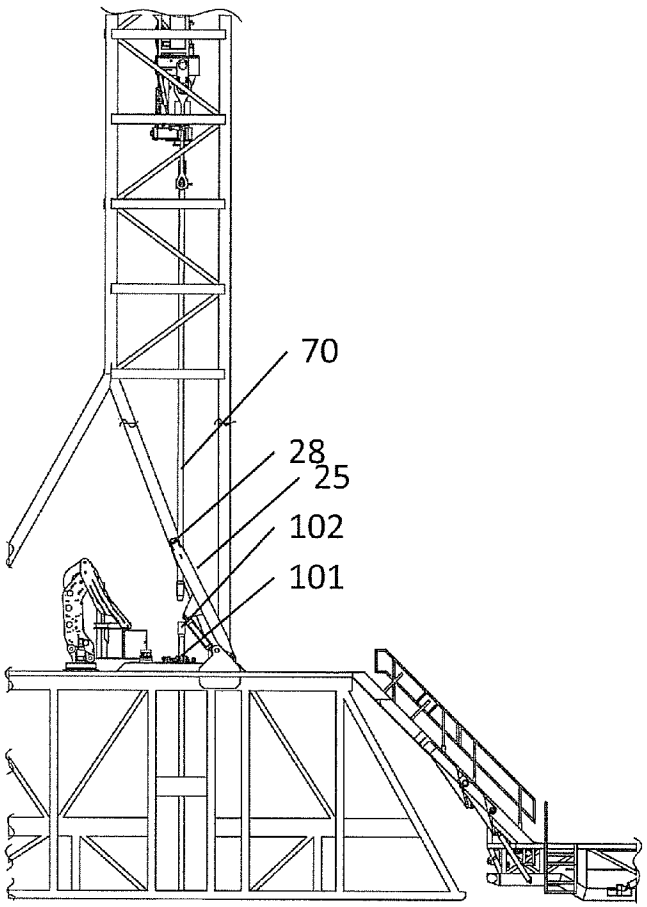

FIG. 15 illustrates the support arm 25 rotated to the well center 101 such that the tubular 70 is in line with well center 101. The tubular guide 28 supports and aligns the tubular 70 as it is lowered to be connected to the drill string 102. Moreover the support arm 25 could rotate to an intermediate position to align the tubular 70 with a mouse hole 103 (see FIG. 1) or transfer the tubular 70 to the vertical tubular storage area 95 (see FIG. 1) location in other aspects of the invention.

Figure 17:
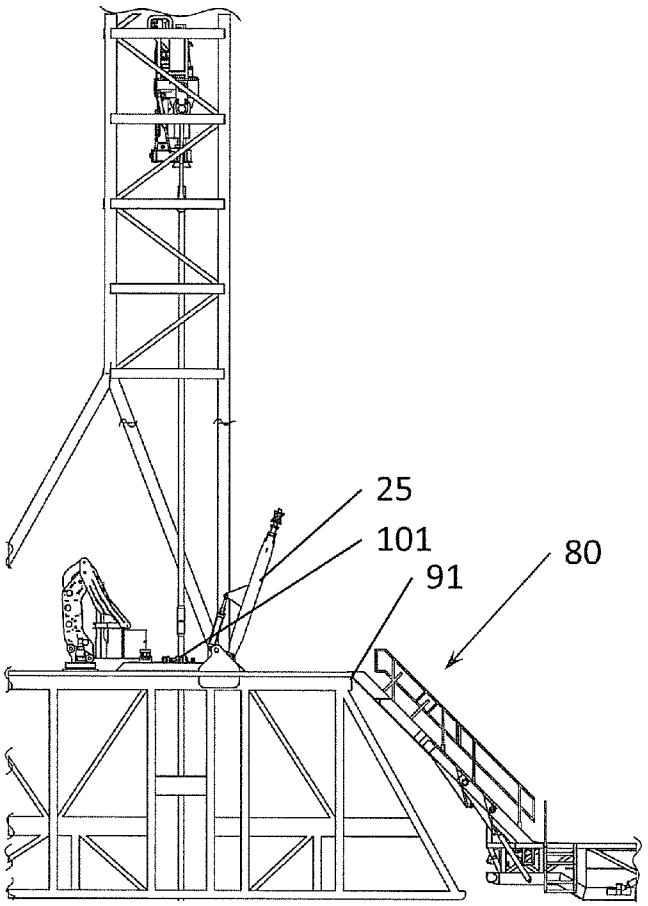
Figure 16:
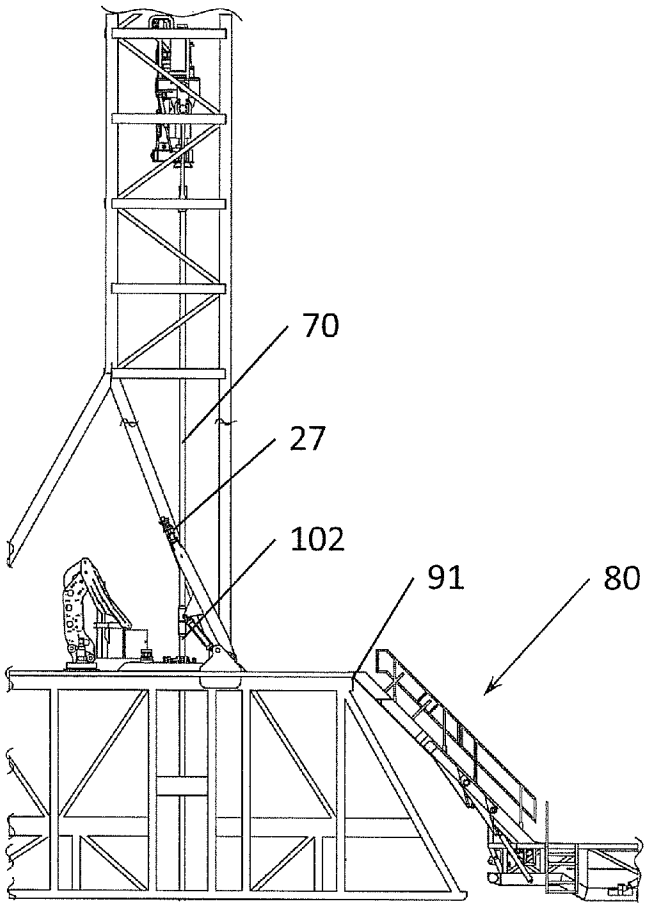

After the tubular 70 is connected to the drill string 102, the guide support 27 is moved to its retracted position as shown in FIG. 16. The support arm 25 can then be rotated way from well center 101 as shown in FIG. 17. To return the tubular 70 from the well center 101 to the pick-up and lay down system 80 or the drill floor edge 91 this process could be reversed.

Figure 18:
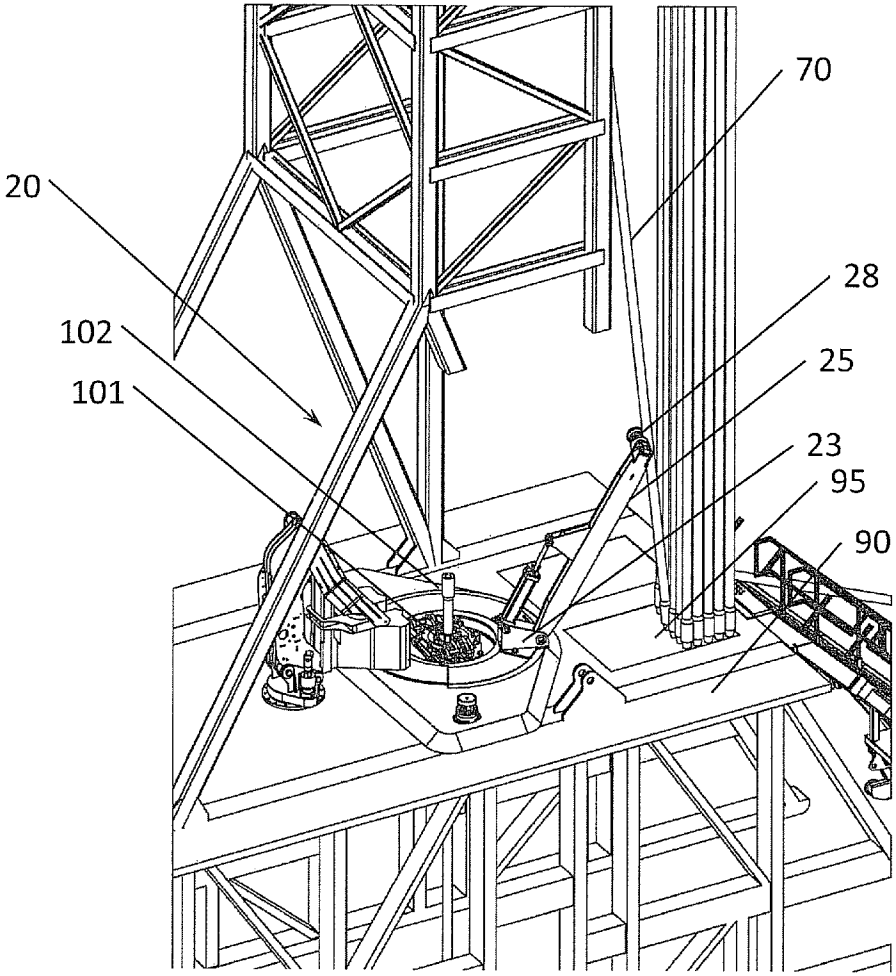
FIGS. 18-19 illustrate perspective views of a method for positioning a tubular from the vertical storage location on a drill floor to well center, according to various embodiments of the present invention.
Figure 19:
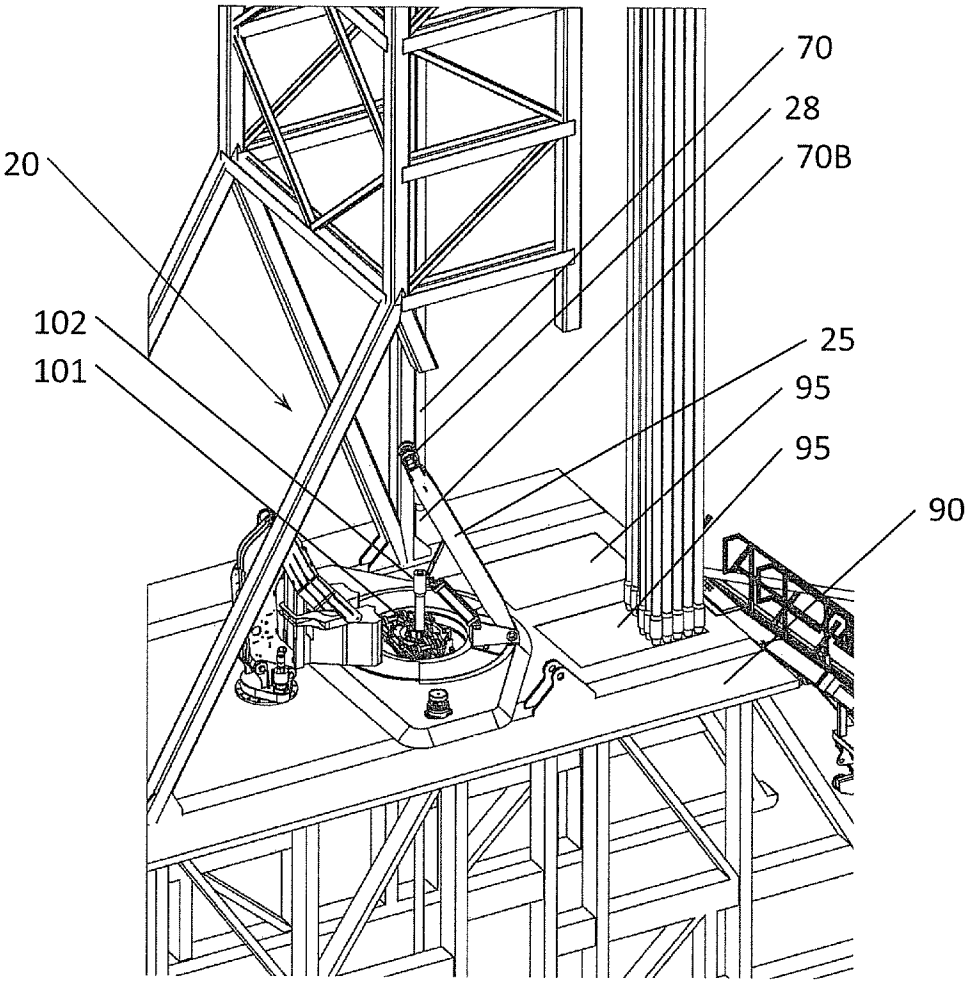

FIGS. 18-19 illustrate a method of using a tubular handling device 20 to transfer a tubular 70 from the vertical storage location 95 to the drill string 102 located at the well center 101 according to an aspect of the present invention. The drive system 24 of FIG. 8A or 8B rotates the arm mount 23 and support arm 25 concentric with the well center 101 until it aligns with the tubular 70 located in the vertical storage area 95 for transfer to the well center 101. The upper end of the tubular 70 is moved to a position generally at well center 101 using mechanisms commonly known by persons of ordinary skill in the art. The tubular 70 is now slanted away from the vertical storage area 95, the support arm 25 is rotated to a point where the tubular guide 28 makes contact with the tubular 70 in FIG. 18. The tubular 70 is raised off of the drill floor 90 and the lower end of the tubular 70 is supported off of the drill floor 90 by the tubular guide 28. The support arm 25 is rotated to the well center 101 such that the tubular 70 is in line with well center 101 in FIG. 19. The tubular guide 28 supports and aligns the tubular 70 as it is lowered to be connected to the drill string 102. Moreover the arm mount 23 and support arm 25 could rotate to an intermediate position to align the tubular 70 with the mouse hole 103 (see FIG. 1) or transfer the tubular 70 to the pick-up and lay down system 80 or the drill floor edge 91.

After the tubular 70 is connected to the drill string 102, the guide support 27 is moved to a retracted position. The support arm 25 can then be rotated away from the well center 101. To return the tubular 70 to a vertical tubular storage 95 location this process could be reversed.

Although a few exemplary embodiments of the present invention have been shown and described, it would be appreciated by those skilled in the art that changes may be made in these exemplary embodiments, without departing from the principles and spirit of the invention, the scope of which is defined in the claims and their equivalents.

What is claimed is:

1. A tubular handling device for use with moving a tubular above a drill floor of a drilling rig, the tubular handling device comprising:

an arm mount slidably disposed in a path which is concentric to a well center within the drill floor;

a support arm rotatably connected to the arm mount; and a tubular guide coupled to the support arm to support the tubular as the support arm is rotated relative to the arm mount while the tubular is moved above the drill floor, wherein the tubular guide is spaced apart from the arm mount;

wherein the arm mount is offset from a plane of a travel path of the lower portion of the tubular relative to the well center.

2. The tubular handling device of claim 1, further comprising a base attached to the drill floor, wherein the arm mount is coupled to the base.

3. The tubular handling device of claim 2, wherein the base comprises:

a guide which contains a circular portion which is concentric to the well center within the drill floor, the arm mount being slidably disposed in the guide; and a drive system disposed at the base, which is configured to move the arm mount along the guide so as to rotate the arm mount around the well center.

4. The tubular handling device of claim 1, further comprising:

a guide support connected to the tubular guide and rotatably connected to the support arm; and an actuator which rotates the guide support between a first position which is generally perpendicular with respect to a support arm position and a second position which is generally parallel with respect to the support arm position.

5. The tubular handling device of claim 1, further comprising:

an actuator which pivots the support arm towards or way from the well center such that a center of the tubular guide remains in a plane that is parallel with the well center.

6. The tubular handling device of claim 1, wherein the support arm comprises an arm guide section which pivots about a longitudinal axis of the support arm to reposition the tubular guide with respect to the support arm.

7. The tubular handling device of claim 1, wherein the arm mount comprises an arm attachment rotatably attached to an arm mount base, wherein the arm attachment rotates about an axis generally parallel with an axis of the well center and repositions the support arm with respect to the arm mount base.

8. The tubular handling device of claim 1, wherein the support arm comprises a telescoping member which extends along a longitudinal axis of the support arm.

9. The tubular handling device of claim 1, wherein the tubular guide supports a lower end of the tubular as the tubular is being positioned to the well center.

10. The tubular handling device according to claim 1, wherein the tubular handling device comprises:

only the one support arm; and only the one tubular guide, wherein the one tubular guide supports the tubular at one location when the tubular is moved above the drill floor.

11. The tubular handling device according to claim 1, wherein the tubular guide is rotatable relative to the support arm about a first axis which is not parallel to a second axis about which the support arm rotates relative to the arm mount, and which is perpendicular to a lengthwise direction of the support arm.

12. The tubular handling device according to claim 5, wherein the guide support is rotatable relative to the support arm about a first axis which is not parallel to a second axis about which the support arm rotates relative to the arm mount, and which is perpendicular to a lengthwise direction of the support arm.

13. A method for positioning a tubular from an edge of a drill floor to a well center on a drilling rig, using a tubular handling device comprising an arm mount slidably moveable in a path which is concentric to a well center within the drill floor, a support arm rotatably connected to the arm mount, and a guide coupled to support arm, the method comprising;

lifting an upper portion of the tubular above the drill floor in a plane passing through an axis of the well center;

moving the upper portion of the tubular along the axis of the well center;

supporting a lower portion of the tubular with the guide while rotating the support arm about the arm mount to move the lower portion of the tubular relative to the well center, wherein the arm mount is offset from a plane of a travel path of the lower portion of the tubular relative to the well center; and moving the guide out of the way of the tubular as the upper end of the tubular is lifted above the drill floor and returning the guide to a position such that the guide can support the lower portion of the tubular before the lower portion of the tubular is lifted above the drill floor by pivoting the guide to a position generally parallel with respect to a support arm position and then pivoting the guide to a position generally perpendicular with respect to the support arm.

14. The method of claim 13, wherein the moving of the upper portion of the tubular while supporting the lower portion of the tubular with the guide comprises pivoting the support arm towards the well center such that the tubular remains in a plane that is aligned with the well center.

15. The method of claim 13, further comprising positioning and aligning the lower portion of the tubular at the well center.

16. The method of claim 13, further comprising pivoting the guide to a position generally parallel with respect to a support arm position, and then rotating the support arm away from the well center.

17. The method according to claim 13, wherein:

the supporting of the lower portion of the tubular comprises:

supporting the lower portion of the tubular at only one location while rotating the support arm, which is the only support arm, about the arm mount; and the returning the guide to the position comprises:

returning the guide, which is the only guide, to the position, which is the only position on the tubular where the lower portion of the tubular is supported.

18. A method for positioning a tubular from a vertical storage location on a drill floor to a well center, using a tubular handling device comprising a guide containing a portion which is concentric to the well center, an arm mount is slidably disposed in said guide, a support arm rotatably connected to the arm mount, and a tubular guide coupled to support arm, the method comprising:

slidably disposing the arm mount in the guide to be in alignment with the tubular and the well center;

lifting an upper portion of the tubular above the drill floor in a plane passing through an axis of the well center;

moving the upper portion of the tubular along the axis of the well center; and supporting a lower portion of the tubular with the tubular guide while rotating the support arm about the arm mount to move the lower portion of the tubular relative to the well center, wherein the arm mount is offset from a plane of a travel path of the lower portion of the tubular relative to the well center.

19. The method of claim 18, further comprising aligning the tubular guide to the tubular by sliding the arm mount in said guide to a position where the tubular guide is aligned with the tubular located in a vertical storage location.

20. The method of claim 18, wherein the moving the upper portion of the tubular to the well center and supporting the lower portion of the tubular with the tubular guide comprises pivoting the support arm towards the tubular such that the tubular guide remains aligned with the tubular and then contacts the tubular.

21. The method of claim 18, wherein the lifting the upper portion of the tubular off of the drill floor while supporting the lower portion of the tubular with the tubular guide comprises pivoting the support arm towards the well center such that the tubular remains in a plane that is aligned with the well center.

22. The method of claim 18, further comprising positioning and aligning the lower portion of the tubular at the well center.

23. The method of claim 18, further comprising pivoting the tubular guide to a position generally parallel with respect to the support arm position then rotating support arm away from the well center.

24. The method according to claim 18, wherein the supporting of the lower portion of the tubular comprises:

supporting the lower portion of the tubular at only one location with the tubular guide, which is the only tubular guide, while rotating the support arm, which is the only support arm about the arm.

25. A tubular handling device for use with moving a tubular above a drill floor of a drilling rig, the tubular handling device comprising:

an arm mount slidably moveable in a path which is concentric to a well center within the drill floor;

only one support arm rotatably connected to the arm mount; and only one tubular guide coupled to the only one support arm, to support the tubular at only one position as the support arm is rotated relative to the arm mount while the tubular is moved above the drill floor, wherein the arm mount is offset from a plane of a travel path of the tubular as the tubular is moved above the drill floor.

26. The tubular handling device according to claim 25, wherein the tubular guide is rotatable relative to the support arm about a first axis which is not parallel to a second axis about which the support arm rotates relative to the arm mount, and which is perpendicular to a lengthwise direction of the support arm.

27. The tubular handling device of claim 25, wherein the support arm comprises a telescoping member which extends along a longitudinal axis of the support arm.

28. A method for positioning a tubular from an edge of a drill floor to a well center on a drilling rig, using a tubular handling device comprising an arm mount slidably moveable in a path which is concentric to the well center within the drill floor, a support arm rotatably connected to the arm mount, and a guide coupled to the support arm, the method comprising;

lifting an upper portion of the tubular above the drill floor along an axis of the well center;

rotating the support arm about the arm mount so that the guide supports the tubular due to gravity while the upper portion of the tubular is lifted; and continuing to raise the upper portion of the tubular above the drill floor in the direction along the axis of the well center while rotating the support arm so that the guide maintains support of the tubular due to the gravity as the lower portion of the tubular approaches the axis of the well center, wherein the arm mount is offset from a plane of a travel path of the lower portion of the tubular as the lower portion of the tubular approaches the axis of the well center.

* * * * *